US005661866A

United States Patent [19]

Cameron

[11] Patent Number: 5,661,866

[45] Date of Patent: Sep. 2, 1997

[54] MOP ASSEMBLY HAVING A RIGID CLAMP TYPE SUPPORT FOR THE MOP ELEMENTS

[76] Inventor: Gary Cameron, 9 Jak-Len Dr., Salisbury, Mass. 01952

[21] Appl. No.: 606,011

[22] Filed: Feb. 12, 1996

[51] Int. Cl.[6] ..... A47L 13/24

[52] U.S. Cl. ..... 15/147.1; 15/153; 15/229.1; 15/229.2

[58] Field of Search ..... 15/147.1, 151, 15/152, 153, 228, 229.1–229.9

[56] References Cited

U.S. PATENT DOCUMENTS

| | | | |
|---|---|---|---|
| 112,014 | 2/1871 | Brizee | 15/147.1 |
| D. 138,041 | 6/1944 | Kautenberg | 15/153 |
| 566,787 | 9/1896 | Mc Ihany | 15/147.1 |
| 1,131,348 | 3/1915 | Ean | 15/147.1 |
| 1,333,021 | 3/1920 | Hamilton | 15/147.1 |
| 1,451,600 | 4/1923 | Van Deusen | 15/151 |
| 1,587,483 | 6/1926 | Flake | 15/153 |
| 1,599,945 | 9/1926 | Bennington | 15/153 |
| 1,650,211 | 11/1927 | Haugen | 15/153 |
| 1,860,402 | 5/1932 | Lorang | 15/229.2 |
| 1,899,283 | 2/1933 | Lorang | 15/147.1 |
| 2,452,177 | 10/1948 | Bodimer | 15/147.1 |
| 2,692,403 | 10/1954 | Friar | 15/153 |
| 2,696,015 | 12/1954 | Richter | 15/147.1 |
| 2,712,144 | 7/1955 | Dunn | 15/151 |
| 2,823,405 | 2/1958 | Jones | 15/153 |
| 3,371,366 | 3/1968 | Ottensmeier | 15/153 |
| 5,230,596 | 7/1993 | Morad | 15/153 |
| 5,481,777 | 1/1996 | Nenninger | 15/151 |

FOREIGN PATENT DOCUMENTS

| | | | |
|---|---|---|---|
| 612438 | 10/1926 | France | 15/147.1 |
| 2003725 | 3/1979 | United Kingdom | 15/147.1 |

*Primary Examiner*—David Scherbel
*Assistant Examiner*—Randall Chin
*Attorney, Agent, or Firm*—Frederick R. Cantor, Esq.

[57] ABSTRACT

A mop assembly is described, which includes a triangularly-shaped support bar having straight terminal end portions attached to a mop handle by two or more transverse bolts. A central bar portion of the triangularly shaped support bar cooperates with an elongated rail to form a clamped connection between the support bar and an essentially conventional flexible dirt pick-up means. The triangular support bar is preferably formed out of aluminum bar stock having a rectangular cross-section.

1 Claim, 1 Drawing Sheet

MOP ASSEMBLY HAVING A RIGID CLAMP TYPE SUPPORT FOR THE MOP ELEMENTS

BACKGROUND OF THE INVENTION

The present invention relates to a mop assembly, and, more particularly, to a mop assembly wherein the flexible dirt pick-up means comprises a plurality of closely spaced rope elements having water-absorbent properties.

The invention is concerned especially with a novel mop head for connecting the closely spaced rope elements to a conventional handle. Typically, the handle will be an elongated cylindrical rod or tube formed of wood, plastic or metal; the novel mop head will be attached to one end of the rod or tube. The person will hold the other end of the handle (rod or tube), whereby the handle can be manipulated to guide the rope element dirt pick-up means across a dirt-laden floor surface.

SUMMARY OF THE INVENTION

The novel mop head comprises a unitary one piece support bar having an essentially triangular-shaped configuration in the plane of the bar. Preferably, the bar is an aluminum bar having a rectangular cross-section, whereby the bar is resistant to bending forces in both directions, i.e., in the plane of the triangular shape, and normal to the triangular plane.

The triangularly-shaped support bar comprises a central linear bar portion extending transverse to the longitudinal axis of the elongated handle, and two curved arm portions that extend from opposite ends of the central bar portion to attachments with the handle. The terminal ends of the curved arm portions extend parallel to the longitudinal axis of the handle so as to have facial engagement with side surfaces of the handle. Bolts extend transversely through the handle and the terminal end portions of the support bar to rigidly attach the support bar to the handle. The triangular shape of the unitary support bar provides strength in the plane of the triangle, and in a transverse plane (i.e., normal to the triangle plane).

The central linear bar portion of the triangular support bar is connected to a central clamping element via two nut-bolt assemblies, whereby the central clamping element can be drawn toward the central linear bar portion to exert a clamp force on the flexible rope elements that constitute the flexible dirt pick-up means. The rope elements are firmly clamped to the triangular support bar, while the triangular support bar is firmly attached to the elongated mop handle.

The principal advantages of the novel mop head are its rigidity, long service life, and good clamp action on the rope type dirt pick-up mechanism. Prior art mop heads are relatively weak and subject to inadvertent detachment or disengagement from the rope elements. The clamp system of the present invention comprises a linear bar portion of the triangular support bar and a linear elongated rail, said bar portion and rail having flat clamping surfaces of extensive surface area, whereby a relatively good clamping action is achieved on the intervening rope element.

The bar and rail are clamped together so as to mutually reinforce each other against bending, twisting or vibrating when the mop is in use. Other features and advantages of the novel mop head clamp system will be apparent from the attached drawings and description of illustrative embodiments of the present invention.

DESCRIPTION OF THE PREFERRED EMBODIMENTS OF THE PRESENT INVENTION

Figure 1:
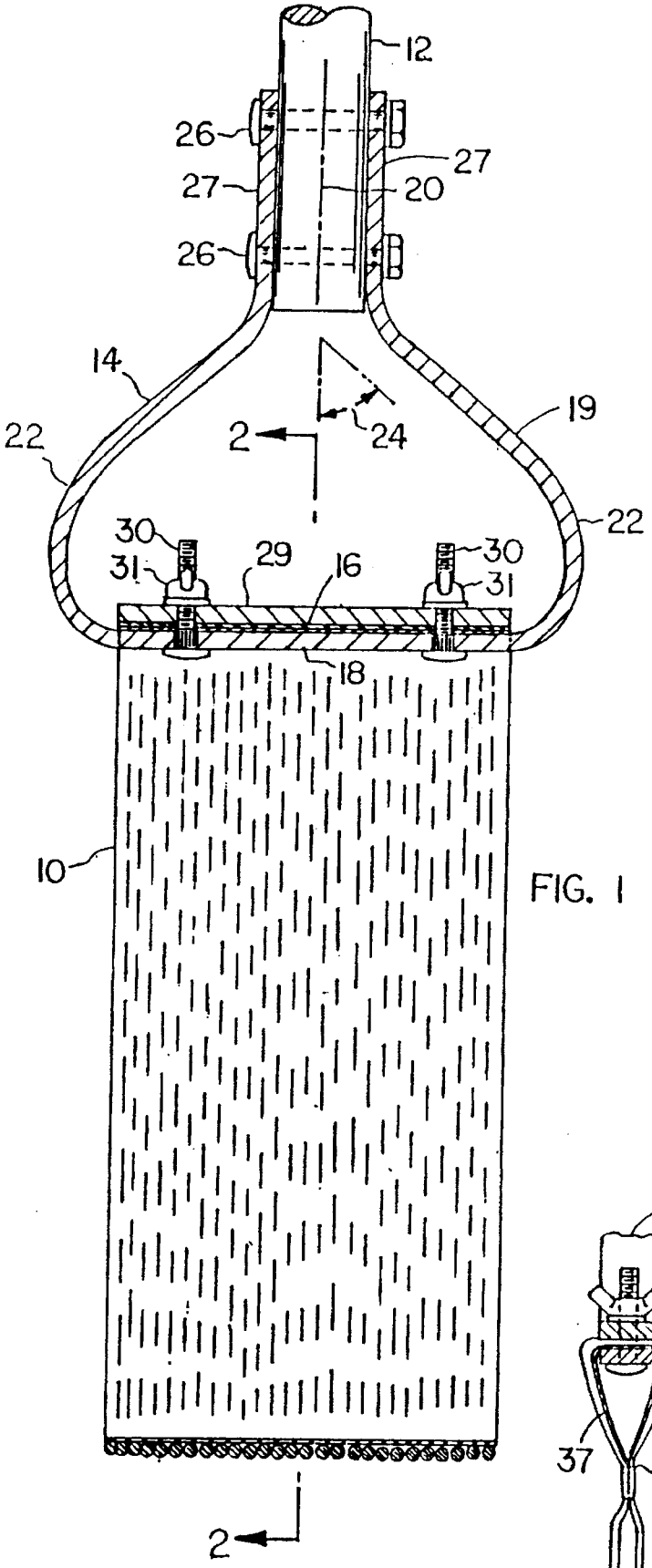
FIG. 1, is a sectional view, taken through a mop assembly constructed according to the invention.
Figure 2:
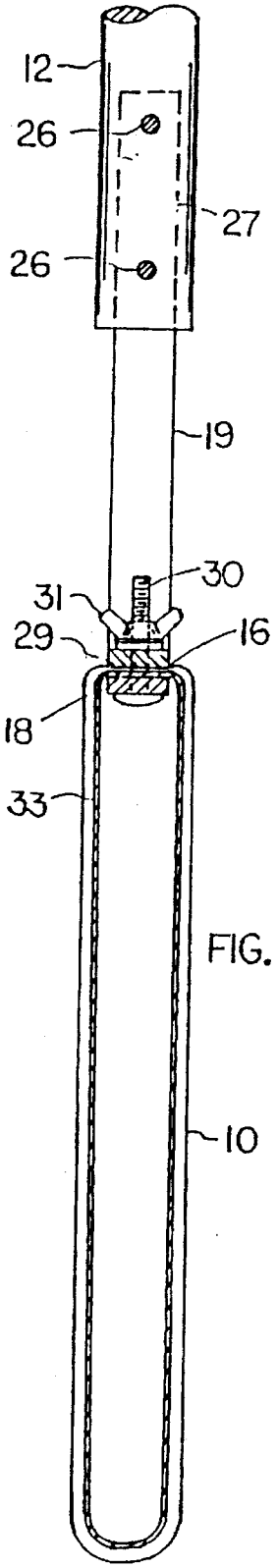
FIG. 2, is a transverse sectional view, taken on line 2—2 FIG. 1.

Referring to FIGS. 1 and 2 of the drawings, there is shown a mop assembly that includes a flexible dirt pick-up means 10, an elongated handle 12, and a mop head 14. The mop head is removably secured to the lower end of handle 12 for supporting the dirt pick-up means 10, via a clamp connection that comprises two bolts 26. The dirt pick-up means 10, can be of conventional construction, e.g., a plurality of closely-spaced rope elements bundled together so as to be clamped as a unit to the mop head 14. As shown in FIG. 1, the flexible dirt pick-up means 10 extends downwardly away from its clamped connection with the mop head 14, so that it can be moved in a swishing back-and-forth motion on a dirt-laden floor surface to pick up dirt particles.

The rope elements that form the dirt pick-up means are ordinarily formed out of cotton, or other water-absorbent material, such that the mop can be dipped into a bucket of soapy water and then moved over the floor surface to enable the soap solution to emulsify the dirt particles. Periodically, the mop will be run through a wringer (roller system)(not shown) to remove dirt-laden solution from the rope elements.

The flexible dirt pick-up means 10 can be conventional. The present invention is concerned most particularly with the mop head 14. As shown in FIG. 1 of the drawing, mop head 14 comprises a unitary, one piece, triangularly-shaped support bar 19 that includes a central linear bar portion 18 extending transverse to the longitudinal axis 20 of handle 12. Typically, handle 12 is an elongated wooden rod (or tube) having a circular cross-section. Mop head 14 is rigidly (but removably) attached to the lower end of the handle 12.

The triangularly-shaped support bar 19 comprises two curved arm portions 22 extending upwardly from opposite ends of linear bar portion 18, so as to reverse direction toward the handle axis 20 at a convergent angle 24, measuring about forty-five (45) degrees. The lower ends of arm portions 22 have a relatively large radius of curvature in order to prevent any local stress points. The upper ends of arm portions 22 extend linearly parallel to the handle axis so as to have facial engagement with side surfaces of handle 12.

The handle 12 is connected to the triangularly-shaped support bar 19 by two bolts 26 that extend transversely through the handle 12 and the terminal end portions 27 of support bar 19. When the handle 12 is bolted to the triangularly-shaped support bar 19, the resultant mop head 14 has strength and rigidity in the plane of the triangle, and also transverse to the triangle plane.

The triangularly-shaped support bar 19 is preferably formed of a single length of aluminum bar stock having a rectangular cross-section. The support bar 19 rectangular cross-section has its major dimension extending transverse to the triangle plane (to provide strength in the transverse plane), and its minor dimension in the triangle plane. The triangular shape of the support bar provides strength in the plane of the triangle. When the support bar 19 is bolted to handle 12, the support bar 19 has a closed loop configuration having hoop stress resistance (similar to a closed triangular hoop).

The support bar 19 cross-section may have a minor dimension of about one-fourth inch, and a major dimension of about three-fourths inch. Such dimensions are sufficient to give the triangular bar 19 the desired strength and rigidity.

The clamped connection 16 between support bar 19 and dirt pick-up means 10, comprises a linear clamping element 29 coextensive with central bar portion 18. Clamping element 29 preferably takes the form of a rigid rail constructed out of the same material that is used to form the triangular support bar 19. The flat facing surfaces of clamping rail 29 and bar portion 18 have extensive surface area engagement with the flexible dirt pick-up means 10, whereby the flexible ropes (that form the pick-up means) are firmly attached to the triangular mop head 14. Clamping rail 29 is drawn toward bar portion 18 by two nut-bolt assemblies 30 extending through aligned holes in the rail and bar portion. The butterfly nuts 31 can be tightened or loosened, to either clamp or free the flexible rope assembly 10, as desired.

FIG. 2, shows a rope assembly (dirt pick-up means) 10 of annular configuration. Such an assembly can comprise a fabric backing sheet 33 for supporting a cotton rope wound on the outer surface of the sheet 33. At selected points on the sheet surface the rope can be adhesively secured to the sheet. FIG. 2, is merely illustrative of one type of flexible rope-type dirt pick-up means that can be used in practice of the invention.

Figure 3:
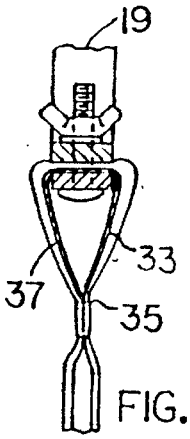
FIG. 3, is a sectional view, taken in the same direction as FIG. 2, but showing the mop head used for supporting a different dirt pick-up element. The mop head of FIG. 3 has the same construction as the mop head depicted in FIGS. 1 and 2.

FIG. 3, is a sectional view, taken in the same direction as FIG. 2, but showing the mop head used for supporting a different dirt pick-up element. The mop head of FIG. 3 has the same construction as the mop head depicted in FIGS. 1 and 2.

FIG. 3, shows another dirt pick-up means, wherein individual rope elements are secured to a backing sheet 33, with facing areas of the sheet and attached rope elements being stitched together, as at 35, to form a loop 37. Backing sheet 33 can be coextensive with the rope elements, as in the arrangement of FIGS. 1 and 2. The loop 37 is trained around central bar portion 18 of the triangular support bar 19, and clamped in place by the clamping rail 29. Installation and removal of this embodiment of rope type dirt pick-up means 10 requires that the triangular support bar 19 be disconnected from handle 12.

A primary advantage of the mop assembly is the very high strength and rigidity of the triangular support bar 19 when it is bolted to the handle 12. The unitary one piece bar has very good resistance against bending, vibrating, or twisting when the mop is in use, thereby eliminating replacement of mop heads over long periods of time, and reducing time spent in the dirt pick-up means.

The mop head can be forcibly impacted against the floor or other surface without bending, cracking or fatiguing. Clamping rail 29 is coextensive with central bar portion 18, such that when the clamping rail 29 is clamped to bar portion 18, the rail and bar portion are mutually reinforcing. The bar portion 18 and rail 29 form a double thickness construction (as viewed in FIG. 1) that is extremely rigid and resistant to bending forces.

The present invention, described above, relates to a mop assembly having a rigid clamp type support for the mop elements. Features of the present invention are recited in the appended claims. The drawings contained herein necessarily depict structural features and embodiments of the mop assembly having a rigid clamp type support for the mop elements, useful in the practice of the present invention.

However, it will be appreciated by those skilled in the arts pertaining thereto, that the present invention can be practiced in various alternate forms, configurations, and mechanical relationships. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts thereto, are considered to be encompassed within the claims of the present invention.

What is claimed is:

1. A mop assembly comprising:

a flexible dirt pick-up means that includes a plurality of closely spaced rope elements having water-absorbent properties;

an elongated handle having side surfaces, and a longitudinal axis;

a mop head removably secured to one end of said handle for supporting said dirt pick-up means, whereby the handle can be manipulated to guide the dirt pick-up means across a dirt-laden floor surface;

said mop head comprising a triangularly-shaped support bar that includes a central linear bar portion extending transverse to the handle longitudinal axis, two convergent arm portions extending from opposite ends of said central bar portion to the side surfaces of said handle, and two terminal end portions (27) extending from said convergent arm portions in facial engagement with said side surfaces of said handle;

a clamping element coextensive with said central bar portion; and means for drawing said clamping element toward said central bar portion;

said closely spaced rope elements having sections thereof, extending between said central bar portion and said clamping element, whereby the dirt pick-up means is clamped to the mop head;

each convergent arm portion comprising an arcuate curved section joined to said central bar portion, each curved section having a center of curvature located a substantial distance from said linear bar portion, whereby each curved section has a sufficient radius of curvature to prevent local stress points in said triangularly-shaped bar;

said triangularly-shaped support bar being a unitary one piece bar having a rectangular cross-section; the rectangular cross-section of the support bar having its major dimension transverse to the plane of the support bar and its minor dimension parallel to the plane of the support bar; and said clamping element being a rigid rail having a rectangular cross-section located within the triangular-shaped bar; and said means for drawing said clamping element toward said central bar portion comprises two bolts extending from said central bar portion through said rigid rail, and nuts threaded onto said bolts against said rail.

* * * * *